US006272812B1

(12) United States Patent
Richardson

(10) Patent No.: US 6,272,812 B1
(45) Date of Patent: Aug. 14, 2001

(54) GLAZED ROOF CONSTRUCTION

(75) Inventor: Christopher Richardson, Clitheroe (GB)

(73) Assignee: Ultraframe (UK) Limited, Clitheroe (GB)

( * ) Notice: Subject to any disclaimer, the term of this patent is extended or adjusted under 35 U.S.C. 154(b) by 0 days.

(21) Appl. No.: 09/506,114

(22) Filed: Feb. 17, 2000

(51) Int. Cl.[7] ..... E04C 2/38

(52) U.S. Cl. ..... 52/800.1; 52/200; 52/235; 52/793.1; 52/204.62

(58) Field of Search ..... 52/793.1, 800.1, 52/235, 204.62, 200

(56) References Cited

U.S. PATENT DOCUMENTS 5,026,581 6/1991 Shea, Jr. et al. .

FOREIGN PATENT DOCUMENTS

| | | |
|---|---|---|
| 3604951 | 8/1987 | (DE) . |
| 835968 | 4/1997 | (EP) . |
| 2678302 | 12/1992 | (FR) . |
| 2754838 | 4/1998 | (FR) . |
| 1400853 | 7/1975 | (GB) . |
| 2106159 | 4/1983 | (GB) . |
| 2115452 | 9/1983 | (GB) . |
| 2300012 | 10/1996 | (GB) . |
| 87/06644 | 11/1987 | (WO) . |

*Primary Examiner*—Beth A. Stephan
*Assistant Examiner*—Dennis L. Dorsey
(74) *Attorney, Agent, or Firm*—Rockey, Milnamow & Katz, Ltd.

(57) ABSTRACT

A roof structure comprises at least one ducted plastics panel having a top wall, bottom wall, and connecting walls, therebetween, said at least one panel being cut to a desired size and having an open space between the top and bottom walls and the last connecting wall, and an adaptor located in said open space, the adaptor having formations thereon for coupling to a glazing bar.

14 Claims, 4 Drawing Sheets

GLAZED ROOF CONSTRUCTION

BACKGROUND OF INVENTION

This invention concerns glazed roof construction and, in particular, concerns glazed roofs formed of ducted plastics panels supported between glazing bars.

Plastics panels for forming glazed roofs are typically produced in standard widths, for example, of 500 mm. Every attempt is made, when designing say a conservatory having a glazed roof, to use a roof requiring only standard width panels, in order to facilitate erection of the roof. However, in some situations, non-standard panel widths are needed because of space considerations. Then standard panels have to be cut down and special arrangements made at the cut down ends to finish the conservatory roof. The plastics panels used may have formations that enable them to be linked directly to glazing bars but if they are cut down, those formations are lost.

There are three typical situations in which non-standard widths panels may be required. The first situation is for a lean-to type of conservatory where the roof panels extend from a wall. If the roof is of non-standard width it is customary to put equal width non-standard panels at each end of the roof for symmetry. The second situation is in a typical duo-pitch conservatory where roof panels are parallel to a wall against which the conservatory is built. In this situation it is customary to put the non-standard width panels abutting the wall.

The third situation is where a conservatory is fitted into a corner and so abuts against two walls, and then the two walls which may not actually be at right angles to each other. In that situation typically the non-standard width panel may have to be cut down to be wider at one end than the other, to accommodate the non-right angle corner, into which it is fitted.

SUMMARY OF THE INVENTION

The problem, therefore, exists of having to accommodate non-standard width roofing panels, cut down from standard width panels to form a satisfactory connection to a wall or to finish off ends of a conservatory roof in a neat and weather proof fashion.

According to this invention it is proposed that an adaptor be provided that can be located in a cut-down ducted plastics roofing panel, the adaptor having a formation thereon for coupling to a glazing bar, such as a conventional end glazing bar or a glazing bar adapted for connection to a wall.

The ducted plastics glazing panels for use with the adaptor typically have a top wall, bottom wall and connecting walls therebetween forming ducts through the panels. The panels may also have intermediate walls parallel to the top and bottom walls to subdivide the ducts. These intermediate walls are usually thinner than the top and bottom walls. To prepare a ducted plastics panel for the adaptor, the panel is cut to the desired size and then any intermediate walls stripped out to leave an open space between the top and bottom walls and the last connecting wall. The adaptor is preferably located in that space by any suitable means. Double sided adhesive tape or screws are the preferred means for locating the adaptor in a panel end space.

The preferred adaptor is generally rectangular in section and may be ducted to improve thermal properties. The ducts are preferably one on top of the other. The adaptor may have its top and bottom walls recessed to provide sites for the double sided adhesive tape. The adaptor preferably has at least one formation extending therefrom whereby it can be coupled to a glazing bar having complementary coupling formations.

The preferred glazing bar for use with the adaptor of the invention has a stem, preferably a ducted stem, with a top formation adapted to receive engagingly formations of a capping, and a groove or slot along one side of the stem for coupling with a corresponding groove or slot of the adaptor coupling formation.

For a glazing bar to be used against a wall, the other side of the glazing bar preferably has a plate linked thereto, which plate itself is, in use, abutted against a wall and secured in place, usually by screws. The glazing bar is preferably arranged to have a bottom cover strip mounted thereon to bridge between the underside of the glazing panel and the wall against which the glazing bar is abutted.

A glazing bar to be used with the adaptor of the invention at a gable end of a conservatory roof preferably has a face to take screws for securing the glazing bar to a supporting side wall, such as provided by window frames. The glazing bar preferably also has a flange on which may be mounted a cover for concealing the outer side of the glazing bar. The cover is preferably adjustably positionable relative to the supporting wall or window or a spacing plate mounted on the supporting wall or window.

According to another aspect of this invention this type of glazing bar may be used without the adaptor to form gable ends of conservatory roofs.

The preferred adaptors of the invention are formed as extrusions from plastics material. The glazing bars are preferably extruded from aluminum.

BRIEF DESCRIPTION OF THE DRAWINGS

This invention will now be further described, by way of example only, with reference to the accompanying drawings, in which.

DETAILED DESCRIPTION OF THE INVENTION

Figure 2:
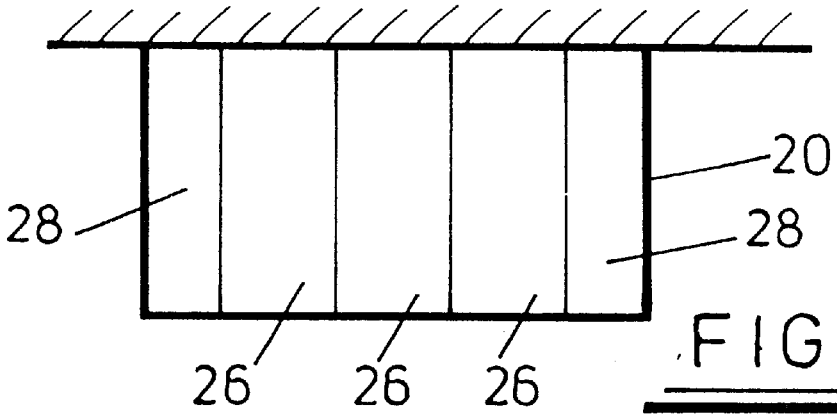
FIG. 2 shows in plan a second type of conservatory roof.
Figure 1:
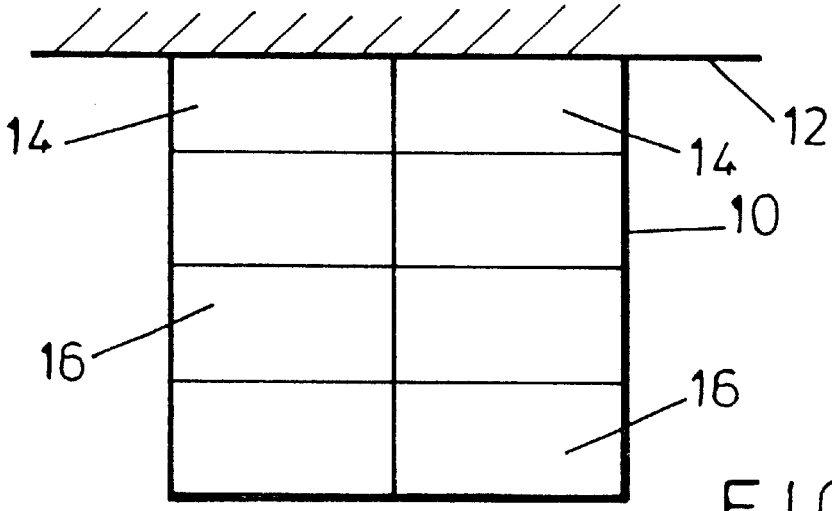
FIG. 1 shows in plan a first type of conservatory roof.
Figure 3:
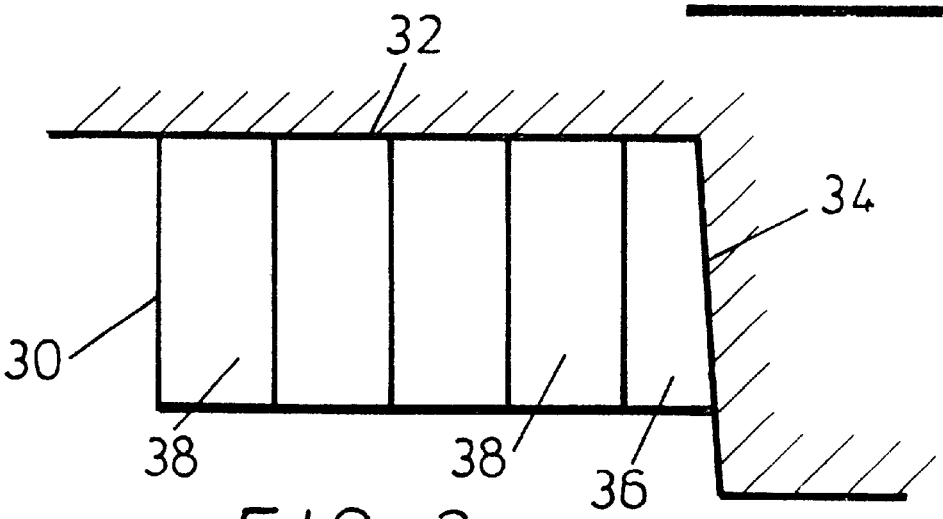
FIG. 3 shows in plan a third type of conservatory roof.

FIGS. 1, 2 and 3 of the accompanying drawings show three probable situations for a conservatory roof, where non-standard width glazing panels have to be used because the space occupied by the conservatory does not allow standard width panels only (typically of 500 mm width) to be used in forming the roof.

In the situation shown in FIG. 1 a duo pitch conservatory roof 10 extends from a wall 12 and has adjacent the wall narrower roofing panels 14 than the remainder 16 which are of standard width.

In FIG. 2, a lean-to type of conservatory roof 20 is shown which has its glazing panels extending away from house wall 24. The roof is of non-standard width and the panels are arranged, so that the standard width panels 26 are intermediate the non-standard width panels 28 at each end of the roof. The non-standard panels are cut to the same width to give the roof symmetry.

FIG. 3 shows a variation of the situation of FIG. 2, on which conservatory roof 30 abuts two wall sections 32, 34, which are not quite at right angles to each. The panel 36 used to complete the conservatory roof is of non-standard width having been cut down from a standard width panel of the type (38) used to form the remainder of the roof.

Figure 4:
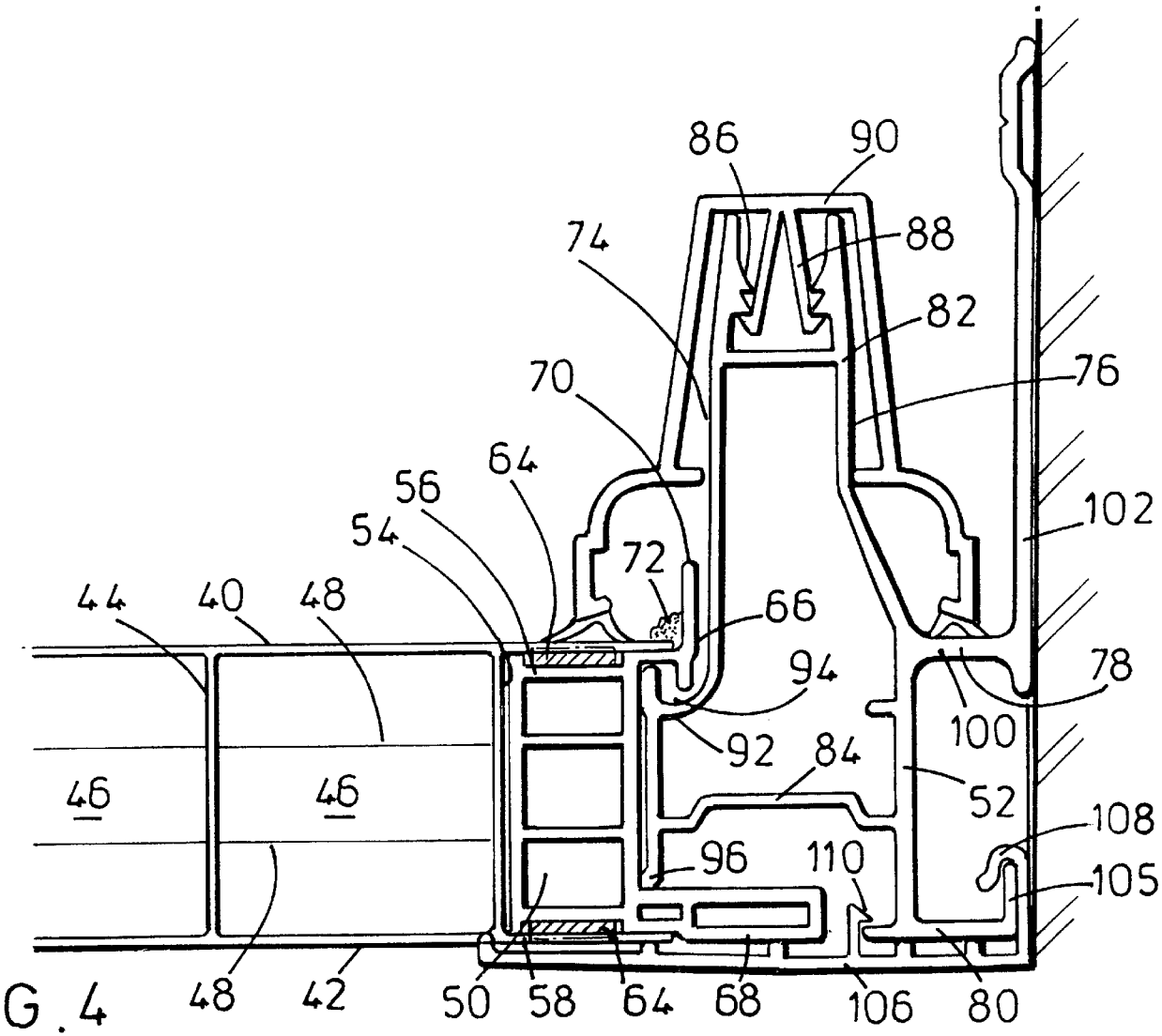
FIG. 4 shows in section part of a conservatory roof of the FIG. 1 type.

FIG. 4 of the drawings illustrates part of a conservatory roof of the type used in the situation shown in FIG. 1. A complete plastics glazing panel used, and which can be partially seen in FIG. 6, has a top wall 40 and a bottom wall 42, connecting walls 44 forming ducts 46 through the panel. Intermediate walls 48 parallel to the top and bottom walls 40, 42 subdivide the ducts. These intermediate walls 48 are thinner than the top, bottom and connecting walls of the panel. At each end of the panel are coupling members for coupling the panel to supporting glazing bars. Typically, there are upper and lower coupling members, the upper ones being downwardly open grooves or slots that mate with upwardly open grooves or slots along sides of the glazing bar. The lower couplings are held together in a slot under the underside of the glazing bar.

However, when a glazing panel has to be cut down to provide a non-standard width panel the coupling formations are, of course, lost. In these circumstances, an adaptor 50 is provided as a coupling to a special glazing bar 52. The plastics panel is cut down to size and the thinner intermediate walls stripped out conveniently using a sharp knife. That leaves a space 54 in the end of the glazing panel into which adaptor 50 is located.

The adaptor 50 has a generally rectangular section body, ducted to improve thermal properties. Top and bottom walls 56, 58 respectively are slightly recessed to provide spaces for double-sided adhesive tape 64 used to fix the adaptor in place. Screws may be used as an alternative fixing means.

The adaptor 50 has upper and lower flanges 66, 68 respectively. The upper flange 66 is in the form of a downwardly open channel by which the adaptor is coupled to glazing bar. The lower flange 68 is in the form of ducted extension that in situ underlies partly the glazing bar to provide a thermal break.

The upper flange 66 also has an upstand 70 against which silicone sealant 72 is applied to seal between the upstand and the end of the top wall 40 of the plastics glazing panel.

The glazing bar 52 is ducted having a first side wall 74 for against the glazing panel and a second side wall spaced from the first with flanges 78, 80 shaped for abutment against the wall. The side walls 74, 76 are connected top and bottom by webs 82 and 84. The side walls 74, 76 extend above the top web and have notches 86 on their inwards surfaces for engagingly receiving formations 88 of a capping member 90.

The first side wall 74 is stepped at 92 intermediate its ends and at the step is an upwardly open channel 94 into which the coupling member 66 of the adaptor 50 is located.

The first side wall 74 extends below bottom web 84 to provide a foot 96 that rests on the lower extension 68 of the adaptor 50. The glazing bar 52 thus has to be pivoted into position by engaging the coupling members 66, 94 of the panel and bar and then pivoting the glazing bar towards the panel.

The second side wall 76 of the glazing bar has intermediate its ends upper flange 78 which has a first part 100 extending horizontally and a second part 102 extending vertically to form a plate that is abutted against the wall and secured in place with screws for which stepped region is provided.

At its lower end, the second side wall 76 extends below the bottom web 84 and at its bottom end is flange 80 extending both inwardly and outwardly. The outward part 105 turns up at its end. This lower flange 80 is adapted to carry a cover strip 106 that bridges between the plastics panel and the house wall. The cover strip 106 has a hook formation 108 at one end that hooks over the outward end 105 of the flange and spaced inwardly therefrom a shaped rib 110 to latch over the inward end of the flange. The cover strip is clipped onto the glazing bar 52 before it is coupled to the glazing panel and screwed to the wall.

The same arrangement can be used in the situation illustrated in FIG. 3 of the drawings. The glazing panel end is cut to the desired angle and the adaptor fitted in the open end of the panel follows that angle, so that the end glazing bar can be secured onto the wall along its length.

Figure 5:
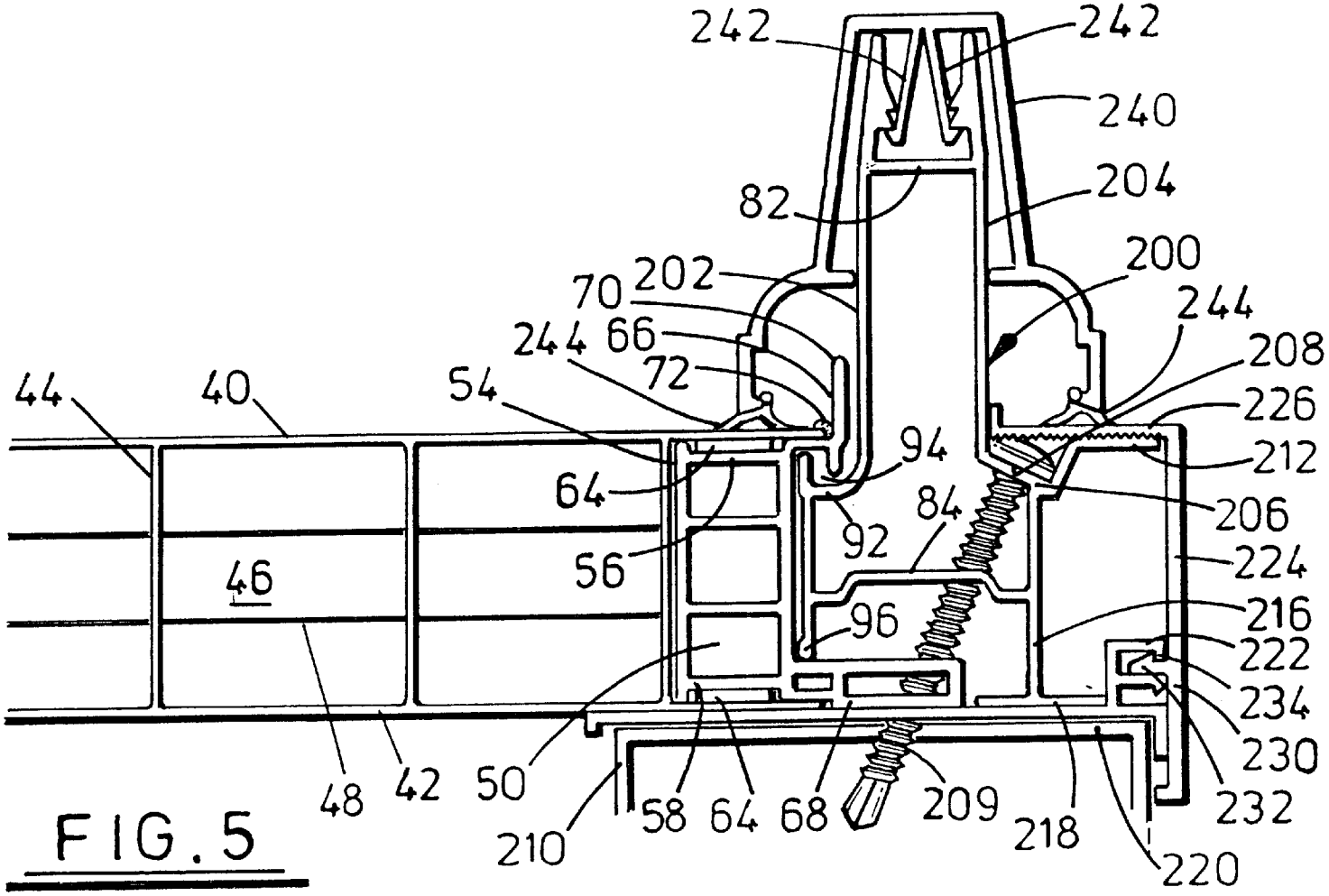
FIG. 5 shows in section part of a conservatory roof of the FIG. 2 type.

Turning to FIG. 5 of the drawings, part of a conservatory roof is shown at a gable end for a lean-to type conservatory. The arrangement is substantially the same as shown in FIG. 4 except for the shape of glazing bar used and provision for variations in alignment of supporting windows relative to the glazing bar. Like components in FIGS. 4 and 5 have been given the same reference numbers.

The glazing bar 200 has a first side 202 which has the same formation as the first side 74 of the glazing bar of FIG. 4. The glazing bar has a second side wall 204 which is stepped to provide a sloping face 206 which has a groove 208 to locate fixing screws 209 through the glazing bar into the top of the windows 210 to fix the glazing bar down. Extending outwardly from the screw face 206 is an upwardly stepped flange 212 having a serrated top surface.

Bottom end 216 of the second side 204 of the glazing bar has a foot 218 extending laterally to both sides. A position adjustable plate 220 is situated on the top of the windows. The plate 220 has on its outer edge a slotted upstand 222. An inverted L-shaped cover piece 224, the top limb 226 of which has a serrated bottom surface to engage the top surface of the flange 212 of the glazing bar and depending limb 230 thereof has a notched rib 232 that locates in the slot 222, which itself has a lip 234 to retain the notched rib 232.

The plate 220 can be positioned as desired on the windows 210 and then the cover strip piece 224 pushed into place.

A capping 240 is pushed into place onto the glazing bar. The capping 240 is of a conventional type having depending formations 242 that engage in the top of the glazing bar and gasket 244 material co-extruded or bonded onto bottom edges of the capping to seal on one side against the cover piece and on the other side onto the top wall of the glazing panel. The gasket material can be of rubber or synthetic elastomeric material.

Figure 6:
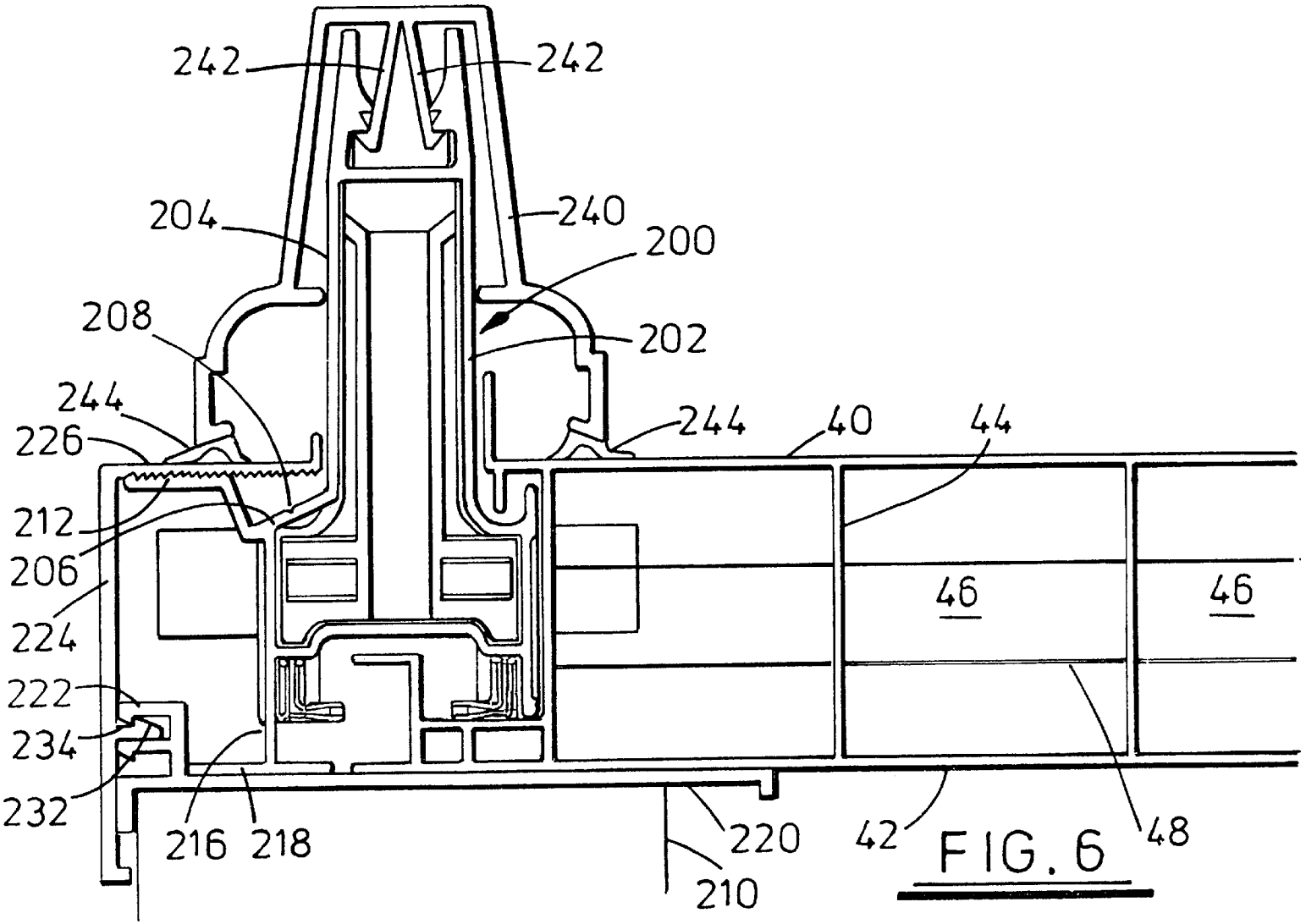
FIG. 6 shows in section part of a conservatory roof gable end featuring another aspect of the invention.

This arrangement may also be used with standard width panels without the adaptor as is shown in FIG. 6 of the drawings, where like parts to those of FIG. 5 have been given the same reference numbers for ease of reference.

What is claimed is:

1. A roof structure comprising a glazing bar and at least one ducted plastics panel having a top wall, a bottom wall, and connecting walls therebetween, said at least one panel being cut to a desired size and having an open space between the top and bottom walls, and further comprising an adaptor located in the open space and being coupled to the glazing bar at a coupling portion of the adaptor.

2. A structure as claimed in claim 1, wherein the adaptor is located in the open space by means of double sided adhesive tape or screws.

3. A structure as claimed in claim 1, wherein the adaptor is generally rectangular in section.

4. A structure as claimed in claim 3, wherein the adaptor is ducted.

5. A structure as claimed in claim 4, wherein the ducts of the adaptor are one on top of the other.

6. A structure as claimed in claim 1, said at least one panel having its top and bottom walls recessed.

7. A structure as claimed in claim 1, wherein the glazing bar has a stem with a top formation adapted to receive engagingly formations of a capping and has a groove or slot along one side of the stem, the groove or slot being adapted for coupling with a corresponding groove or slot of the adaptor coupling formation.

8. A structure as claimed in claim 7, wherein the glazing bar on its opposite side a plate linked thereto, which, in use, abuts a wall.

9. A structure as claimed in claim 8, wherein the glazing bar has a bottom cover mounted thereon and adapted to bridge between the underside of said at least one plastics panel and a wall to which, in use, the plate abuts.

10. A structure as claimed in claim 7, wherein the glazing bar has a face to take screws for securing the glazing bar to a supporting side wall.

11. A structure as claimed in claim 10, wherein the glazing bar has a flange on which is mounted a cover for concealing the outer side of the glazing bar.

12. A structure as claimed in claim 11, wherein the cover is adjustably positionable relative to the supporting wall or a spacing plate mounted on the wall.

13. A structure as claimed in claim 1, wherein the adaptor is extruded from plastics material.

14. A structure as claimed in claim 1, wherein the glazing bar is extruded from aluminum.

* * * * *